US006781561B2

(12) United States Patent
Huang et al.

(10) Patent No.: US 6,781,561 B2
(45) Date of Patent: Aug. 24, 2004

(54) ANTENNA FOR A TIRE PRESSURE DETECTOR

(75) Inventors: John Huang, Taichung (TW); Chi-Hui Chuang, Kaohsiung (TW)

(73) Assignee: Lite-On Automotive Corp., Kaohsiung (TW)

( * ) Notice: Subject to any disclaimer, the term of this patent is extended or adjusted under 35 U.S.C. 154(b) by 0 days.

(21) Appl. No.: 10/384,971

(22) Filed: Mar. 10, 2003

(65) Prior Publication Data

US 2004/0108965 A1 Jun. 10, 2004

(30) Foreign Application Priority Data

Dec. 4, 2002 (TW) ..... 91219635 U

(51) Int. Cl.[7] ..... H01Q 1/36
(52) U.S. Cl. ..... 343/895; 343/711
(58) Field of Search ..... 343/895, 711, 343/713

(56) References Cited

U.S. PATENT DOCUMENTS 3,940,772 A * 2/1976 Ben-dov ..... 343/853
6,181,298 B1 * 1/2001 Strickland ..... 343/895
6,222,506 B1 * 4/2001 So ..... 343/895

* cited by examiner

*Primary Examiner*—James Vannucci
(74) *Attorney, Agent, or Firm*—William E. Pelton, Esq.

(57) ABSTRACT

An antenna for a tire pressure detector is installed on an RF circuit board of the tire pressure detector. The antenna has a seat with a bottom plate. A post is uprightly formed on the bottom plate. A plurality of positioning members evenly formed at an outer periphery of the post. A wire electrically connected with the RF circuit board is coiled round the post and positioned in the positioning members. A cover has a body provided outside the seat. A bolt is inserted through the cover to fasten the antenna on the RF circuit board. The antenna has a low manufacturing cost, and is convenient to be installed.

7 Claims, 2 Drawing Sheets

ANTENNA FOR A TIRE PRESSURE DETECTOR

BACKGROUND OF THE INVENTION

1. Field of the Invention

The present invention is related to an antenna for a tyre pressure detector, and more particularly to an antenna for transmitting signals of tyre pressure.

2. Description of Related Art

A tyre pressure detector is installed in a tyre of a vehicle and used for detecting pressures of the tyre during running of the vehicle. An antenna is installed on a chassis of the vehicle for receiving signals of detected tyre pressure and transmitting these signals by an RF (Radio Frequency) circuit board to a dashboard of the vehicle.

The conventional antenna is a PCB (Printed Circuit Board) formed by means of etching, and electrically connected and welded with the RF circuit board by a shielded cable. However, the conventional antenna has a high manufacturing cost, and it is also inconvenient to weld the antenna with the RF circuit board.

Therefore, the invention provides an antenna for a tyre pressure detector to mitigate and/or obviate the aforementioned problems.

SUMMARY OF THE INVENTION

The main objective of the invention is to provide an antenna for a tyre pressure detector which has a low cost and is convenient to be installed on an RF circuit board.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
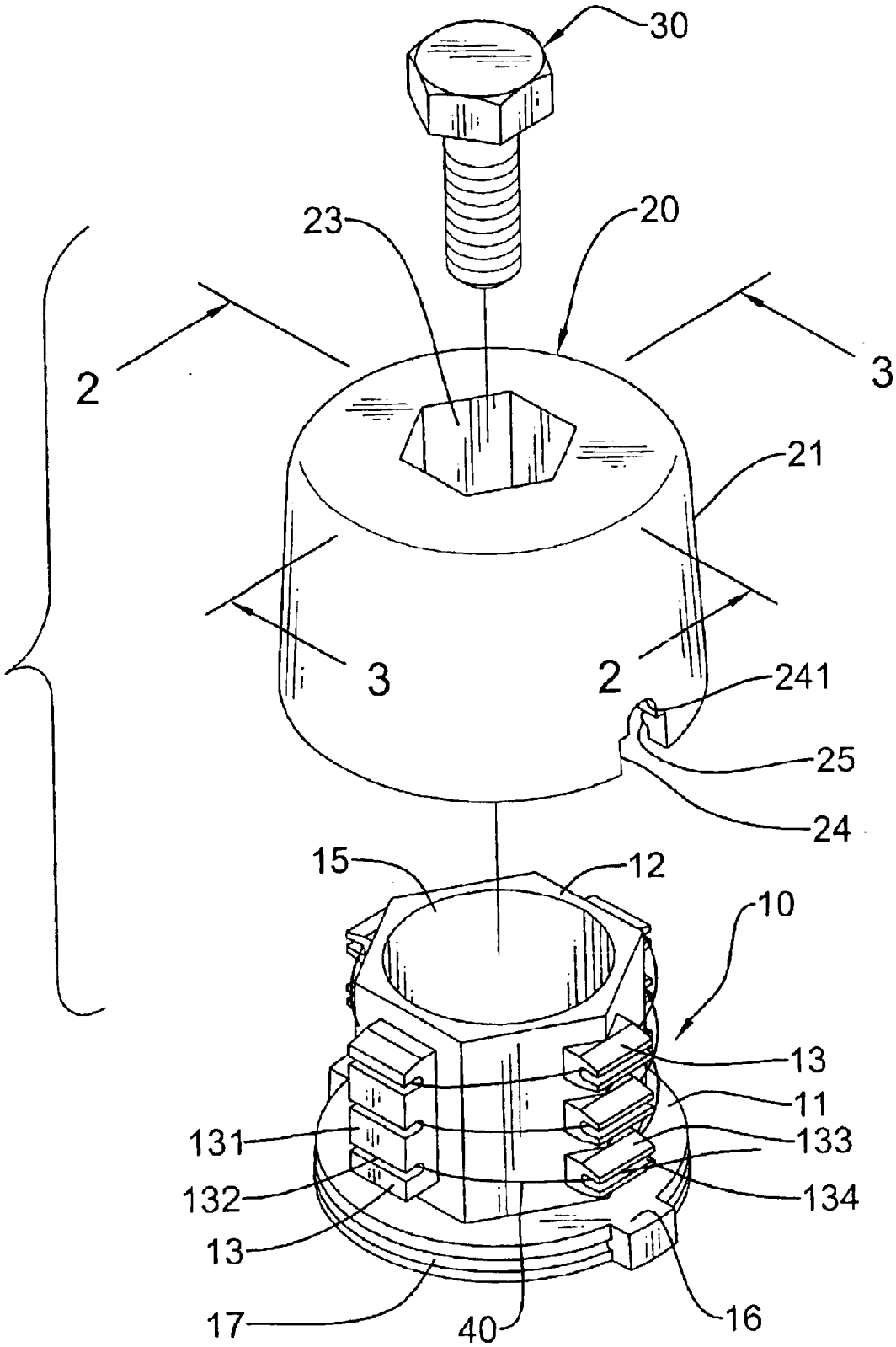
FIG. 1 is an exploded perspective view of an antenna for a tyre pressure detector in accordance with the invention.
Figure 2:
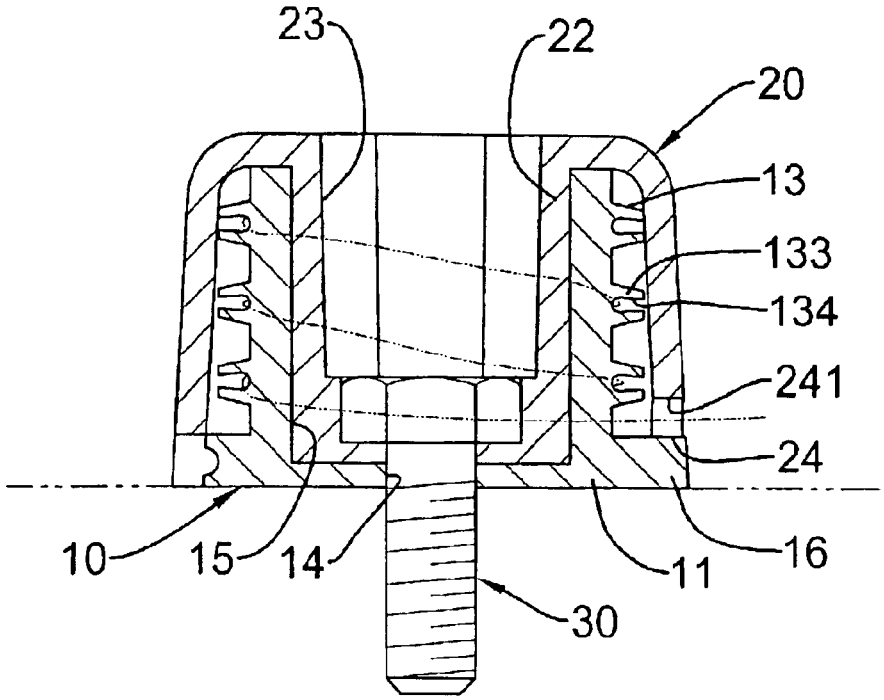
FIG. 2 is a sectional view of the antenna taken along the line "2—2" in FIG. 1.
Figure 3:
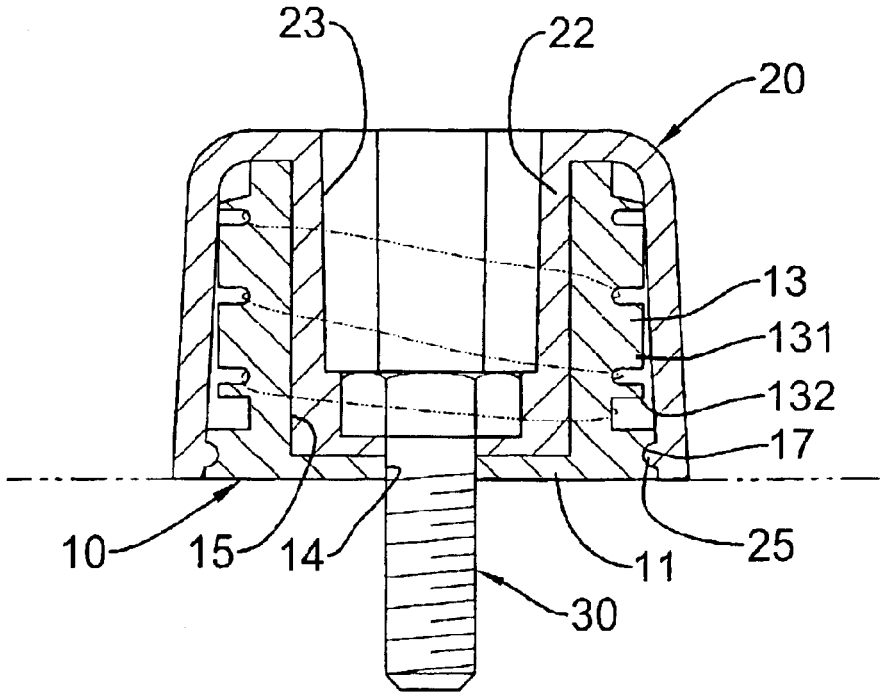
FIG. 3 is a sectional view of the antenna taken along the line "3—3" in FIG. 1.

Referring to FIGS. 1–3, in accordance with the present invention, an antenna for a tyre pressure detector is installed on an RF (Radio Frequency) circuit board (not shown or numbered) of the tyre pressure detector, and is composed of a seat (10) and a cover (20). The seat (10) and the cover (20) are made of plastic by means of injection molding.

The seat (10) has a bottom plate (11) and a post (12) uprightly formed on the bottom plate (11). An aperture (14) is defined through the bottom plate (11), and a hole (15) is defined through the post (12) and coaxial with the aperture (14). A plurality of lugs (16) is evenly formed at a circumference of the bottom plate (11), and a ring recess (17) is defined around the circumference of the bottom plate (11).

A plurality of positioning members is evenly formed at an outer periphery of the post (12). In this embodiment, the positioning members include first positioning members (13*a*) and second positioning members (13*b*) alternately arranged around the post (12). The first positioning members (13*a*) each have an elongate block (131) and a plurality of first channels (132) transversally defined through the elongated block (131). The second positioning members (13*b*) each have a plurality of tongues (133) longitudinally arranged at the outer periphery of the post (12) and each with a second channel (134) transversally defined through the respective tongue (133).

A wire (40) electrically connected with the RF circuit board is coiled around the post (12) and positioned in the first channels (132) and the second channels (134).

According to the present invention, the positioning members also can be all the first positioning members (13*a*) or all the second positioning members (13*b*).

The cover (20) has a body (21) provided outside the seat (10), a central portion (22) extending in the hole (15), and an opening (23) defined through the central portion (22) and aligned with the aperture (14). A bolt (30) is inserted through the opening (23) and the aperture (14) to fasten the antenna on the RF circuit board.

A plurality of first notches (24) is defined at a bottom side of the body (21), and a second notch (241) is defined above one of the first notches (24). The lugs (16) are respectively positioned in the first notches (24), and the wire (40) extends out from the second notch (241). A ridge (25) is circumferentially formed at an inner wall of the body (21) and positioned in the ring recess (17) of the seat (10) to further fasten the cover (20) on the seat (10).

Therefore, the tyre pressure signals from the RF circuit board can be transmitted by the antenna and displayed on a dashboard in a car.

According to the present invention, the antenna has a simple structure, so that a manufacturing cost is low. Furthermore, it is very convenient to install the antenna to the RF circuit board by the bolt (30).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna for a tyre pressure detector, the antenna mounted on an RF circuit board of the tyre pressure detector and comprising:

a seat (10) having a bottom plate (11), a post (12) uprightly formed on the bottom plate (11), an aperture (14) defined through the bottom plate (11), a hole (15) defined through the post (12) and coaxial with the aperture (14), and a plurality of positioning members evenly formed at an outer periphery of the post (12);

a wire (40) electrically connected with the RF circuit board and coiled round the post (12) and positioned in the positioning members;

a cover (20) having a body (21) provided outside the seat (10), a central portion (22) extending in the hole (15), and an opening (23) defined through the central portion (22) and aligned with the aperture (14); and a bolt (30) inserted through the opening (23) and the aperture (14) to fasten the antenna on the RF circuit board.

2. The antenna as claimed in claim 1, wherein the positioning members (13*a*) each have an elongate block (131)

and a plurality of first channels (132) transversally defined through the elongated block (131), and the wire (40) is positioned in the first channels (132).

3. The antenna as claimed in claim 1, wherein the positioning members (13*b*) each have a plurality of tongues (133) longitudinally arranged at the outer periphery of the post (12) and each with a second channel (134) transversally defined through the respective tongue (133), and the wire (40) is positioned in the second channels (134).

4. The antenna as claimed in claim 1, wherein the positioning members includes first positioning members (13*a*) and second positioning members (13*b*) alternately arranged around the post (12), wherein the first positioning members (13*a*) each have an elongate block (131) and a plurality of first channels (132) transversally defined through the elongated block (131), the second positioning members (13*b*) each have a plurality of tongues (133) longitudinally arranged at the outer periphery of the post (12) and each with a second channel (134) transversally defined through the respective tongue (133), and the wire (40) is positioned in the first and second channels (132, 134).

5. The antenna as claimed in claim 1, wherein the seat (10) has a plurality of lugs (16) formed at a circumference of the bottom plate (11), and a plurality of first notches (24) defined at a bottom side of the body (21), and the lugs (16) are respectively positioned in the first notches (24).

6. The antenna as claimed in claim 5, wherein the cover (20) has a second notch (241) defined above one of the first notches (24), and the wire (40) extends out from the second notch (241).

7. The antenna as claimed in claim 1, wherein the seat (10) has a ring recess (17) defined around the circumference of the bottom plate (11), and a ridge (25) is circumferentially formed at an inner wall of the body (21) and positioned in the ring recess (17) of the seat (10).

* * * * *